US010980325B2

(12) United States Patent
Minichiello

(10) Patent No.: US 10,980,325 B2
(45) Date of Patent: Apr. 20, 2021

(54) TELESCOPIC HANDLE FOR A SUITCASE

(71) Applicant: FERRARI S.p.A., Modena (IT)

(72) Inventor: Silvio Minichiello, Grugliasco (IT)

(73) Assignee: FERRARI S.P.A., Modena (IT)

( * ) Notice: Subject to any disclaimer, the term of this patent is extended or adjusted under 35 U.S.C. 154(b) by 0 days.

(21) Appl. No.: 16/682,013

(22) Filed: Nov. 13, 2019

(65) Prior Publication Data

US 2020/0154843 A1 May 21, 2020

(30) Foreign Application Priority Data

Nov. 15, 2018 (IT) ..... 102018000010366

(51) Int. Cl.
*A45C 13/22* (2006.01)
*A45C 13/26* (2006.01)
*A45C 5/14* (2006.01)

(52) U.S. Cl.
CPC ..... *A45C 13/262* (2013.01); *A45C 5/14* (2013.01); *A45C 2013/267* (2013.01)

(58) Field of Classification Search
CPC ..... Y10T 16/451; Y10T 16/473; A45C 13/26; A45C 13/262; A45C 2013/26; A45C 2013/267; A45C 2013/262; A45C 5/14; B62B 5/06; B62B 5/067; B62B 5/065; B25H 3/02
See application file for complete search history.

(56) References Cited

U.S. PATENT DOCUMENTS 5,379,486 A * 1/1995 Wang ..... A45C 13/262 16/113.1
5,400,472 A * 3/1995 Chang ..... B62B 1/125 16/113.1
5,553,350 A * 9/1996 Chang ..... A45C 13/262 16/113.1
5,581,846 A * 12/1996 Wang ..... A45C 13/262 16/113.1
5,581,847 A * 12/1996 Hsieh ..... A45C 13/262 16/113.1

(Continued)

FOREIGN PATENT DOCUMENTS

FR 2737090 A3 * 1/1997 ..... A45C 13/262
JP 2015136398 A 7/2015

OTHER PUBLICATIONS

Search Report issued in Italian Application No. 201800010366, completed Jul. 3, 2019; 8 pages.

*Primary Examiner* — Chuck Y Mah
(74) *Attorney, Agent, or Firm* — Cantor Colburn LLP

(57) ABSTRACT

A telescopic handle for a suitcase having: a fixed plate, which is designed to be fixed to a rear wall of the suitcase; a movable plate, which is coupled to the fixed plate in a sliding manner; a grip, which is fixed to the movable plate, is "U"-shaped, and comprises a handle, which is connected to the movable plate by means of two connection cross-pieces, which are arranged at the opposite ends of the handle; and a locking system, which is designed to lock the sliding of the movable plate relative to the fixed plate when it reaches a contracted position and an extended position. The locking system has a control lever, which is arranged inside the grip between the two connection crosspieces and is hinged to the two connection crosspieces so as to rotate around a rotation axis, which is perpendicular to the sliding direction.

15 Claims, 8 Drawing Sheets

(56) References Cited

U.S. PATENT DOCUMENTS

| | | | | | |
|---|---|---|---|---|---|
| 5,620,070 | A | | 4/1997 | Wang | |
| 5,639,109 | A | * | 6/1997 | Liang | A45C 13/262 16/113.1 |
| 5,970,579 | A | * | 10/1999 | Lu | A45C 13/262 16/405 |
| 6,009,598 | A | * | 1/2000 | Chang | A45C 13/262 16/113.1 |
| 6,061,871 | A | * | 5/2000 | Wang | A45C 13/262 16/113.1 |
| 6,081,967 | A | * | 7/2000 | Chang | A45C 13/262 16/113.1 |
| 6,148,477 | A | * | 11/2000 | Cheng | A45C 13/262 16/113.1 |
| 6,920,666 | B1 | * | 7/2005 | Chen | A45C 13/262 16/113.1 |
| 8,534,434 | B2 | * | 9/2013 | Crull | B25H 3/02 190/117 |
| 2005/0183914 | A1 | * | 8/2005 | Lin | A45C 13/262 190/115 |
| 2016/0045000 | A1 | | 2/2016 | Green | |

* cited by examiner

TELESCOPIC HANDLE FOR A SUITCASE

CROSS-REFERENCE TO RELATED APPLICATIONS

This application claims priority from Italian Patent Application No. 102018000010366 filed on Nov. 15, 2018, the disclosure of which is incorporated by reference.

TECHNICAL FIELD

This invention relates to a telescopic handle for a suitcase.

The invention finds advantageous application in a suitcase with wheels (normally referred to as roller case), to which explicit reference will be made in the description below without because of this loosing in generality.

PRIOR ART

A suitcase with wheels (namely, a roller case) comprises an openable shell with the shape of a parallelepiped, which can house the objects to be transported. At least two wheels, which allow the suitcase to roll on the ground, are fixed to a lower wall of the shell and a telescopic handle is fixed to the rear wall of the shell, said telescopic handle being movable between an extended position, in which the handle is at a given distance from the shell so as to allow users to pull the suitcase without having to bend, and a contracted position, in which the handle is close to the shell so as to minimize the space occupied when the suitcase does not need to be pulled.

Patent applications JP2015136398A and U.S. Pat. No. 5,620,070A disclose a suitcase provided with a telescopic handle, whose extension or contraction movement is locked by a locking system, which is controlled by a control lever, which is coupled to a grip of the telescopic handle.

DESCRIPTION OF THE INVENTION

The object of the invention is to provide a telescopic handle for a suitcase, said telescopic handle having small dimensions as well as a limited weight and being, at the same time, adequately sturdy and resistant so as to have a very long operation life, even if it is subjected to an intense use.

According to the invention, there is provided a telescopic handle for a suitcase according to the appended claims.

The appended claims describe preferred embodiments of the invention and form an integral part of the description.

BRIEF DESCRIPTION OF THE DRAWINGS

The invention will now be described with reference to the accompanying drawings, showing a non-limiting embodiment thereof, wherein.

PREFERRED EMBODIMENTS OF THE INVENTION

Figure 1:
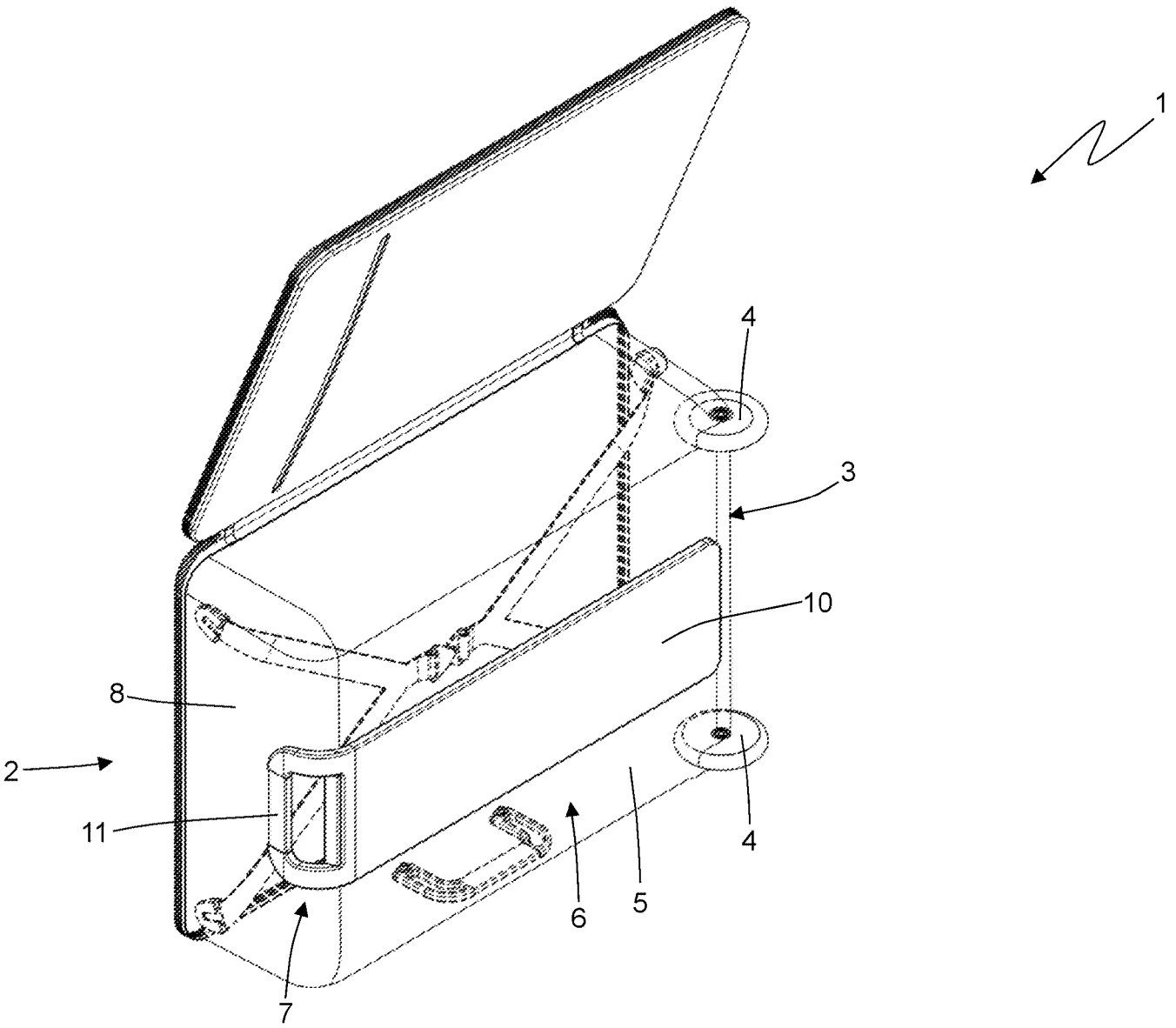
FIG. 1 is a perspective view of a suitcase with wheels provided with a telescopic handle, which is manufactured according to the invention and is arranged in a rest position.

In FIG. 1, number 1 indicates, as a whole, a suitcase with wheels (namely, a roller case).

The suitcase 1 comprises an openable shell 2 with the shape of a parallelepiped, which can hold the objects to be transported. Two wheels 4, which allows the suitcase 1 to roll on the ground, are fixed to a lower wall 3 of the shell 2 and a telescopic handle 6, which is provided with a grip 7 designed to be grabbed by a user, is fixed to a rear wall 5 of the shell 2. The telescopic handle 6 is movable (by means of an axial sliding movement) between a rest position (shown in FIG. 1), in which the grip 7 adheres to (rests against) an upper wall 8 of the suitcase 1, a contracted position (not shown), in which the grip 7 is (slightly) detached (for example, at 4-5 cm) from the upper wall 8 of the suitcase 1, and an extended position (shown in FIG. 2), in which the handle 7 is farther from the upper wall 8 of the suitcase 1 than in the contracted position, so as to allow users to pull the suitcase 1 without having to bend. The rest position is used to minimize the space occupied when the suitcase 1 does not, need either to be pulled or to be lifted, the contracted position is used when the suitcase 1 needs to be lifted from the upper wall 8 using the grip 7 (the upper wall 8 does not have other grabbing members besides the grip 7), and the extended position is used when the suitcase 1 needs to be pulled so as to move on the wheels 4.

Figure 2:
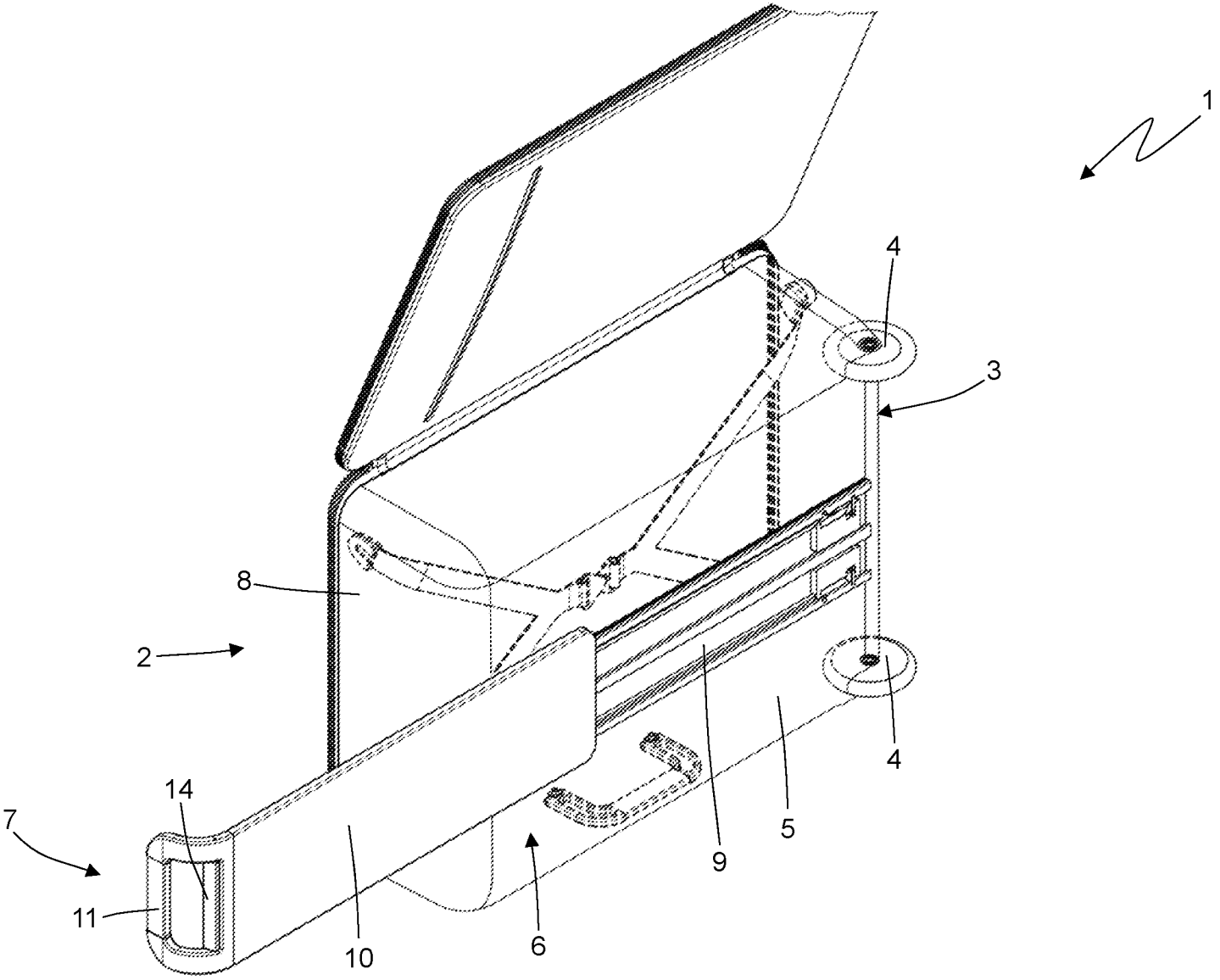
FIG. 2 is a perspective view of the suitcase of FIG. 1, in which the telescopic handle is arranged in an extended position.
Figure 3:
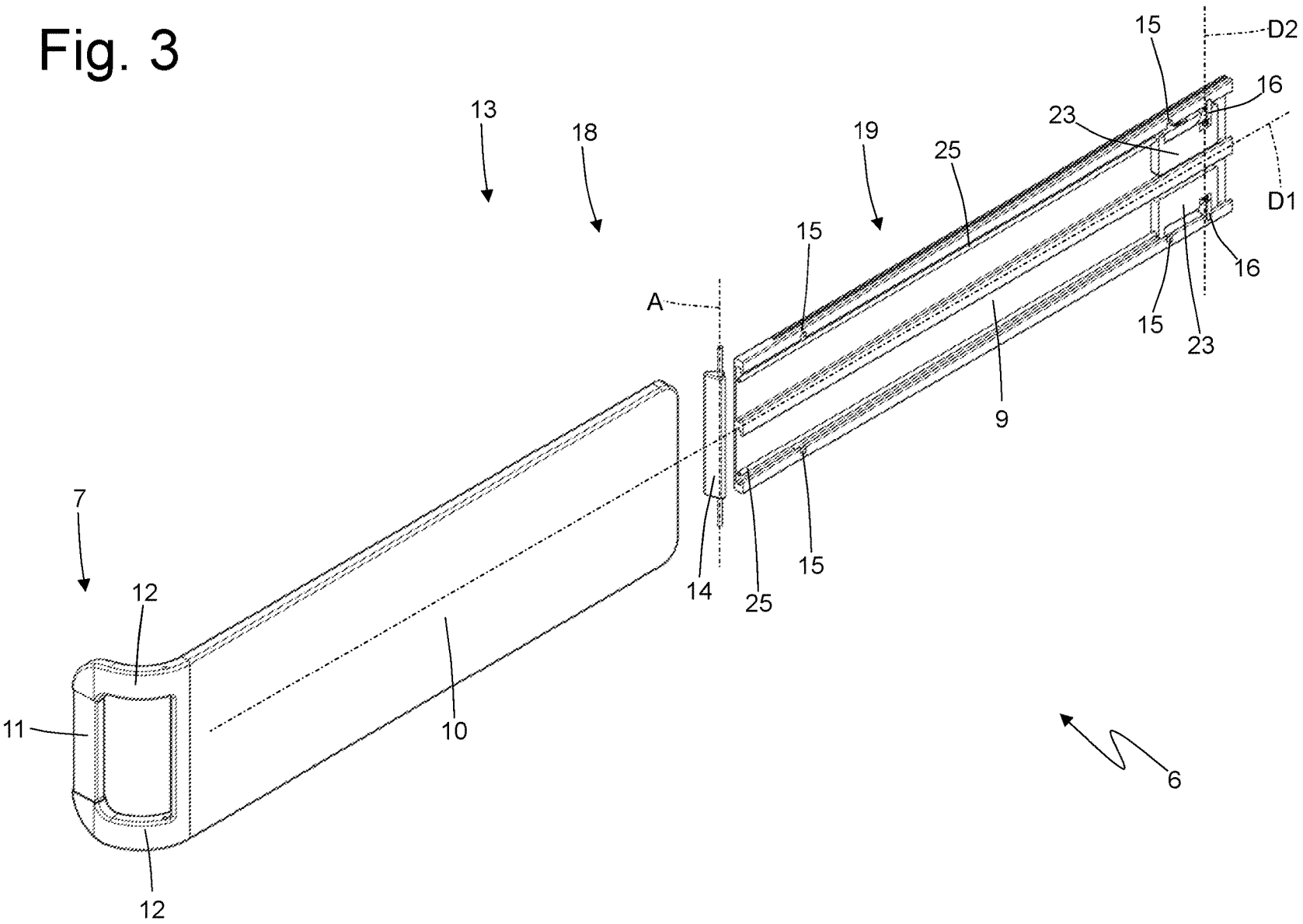
FIG. 3 is a perspective and exploded view of the telescopic handle of FIG. 1.

According to FIGS. 2 and 3, the telescopic handle 6 comprises a fixed plate 9, which is designed to be fixed (typically screwed) to the rear wall 5 of the shell 2 of the suitcase 1, and a movable plate 10, which is coupled to the fixed plate 9 is a sliding manner so as to slide relative to the fixed plate 9 along a sliding direction D1 and between the rest, contracted and extended positions. Furthermore, the telescopic handle 6 comprises the grip 7, which is rigidly fixed to an upper wall of the movable plate 10 (namely, the grip 7 cannot make any movement relative to the movable plate 10) and is "U"-shaped.

Figure 4:
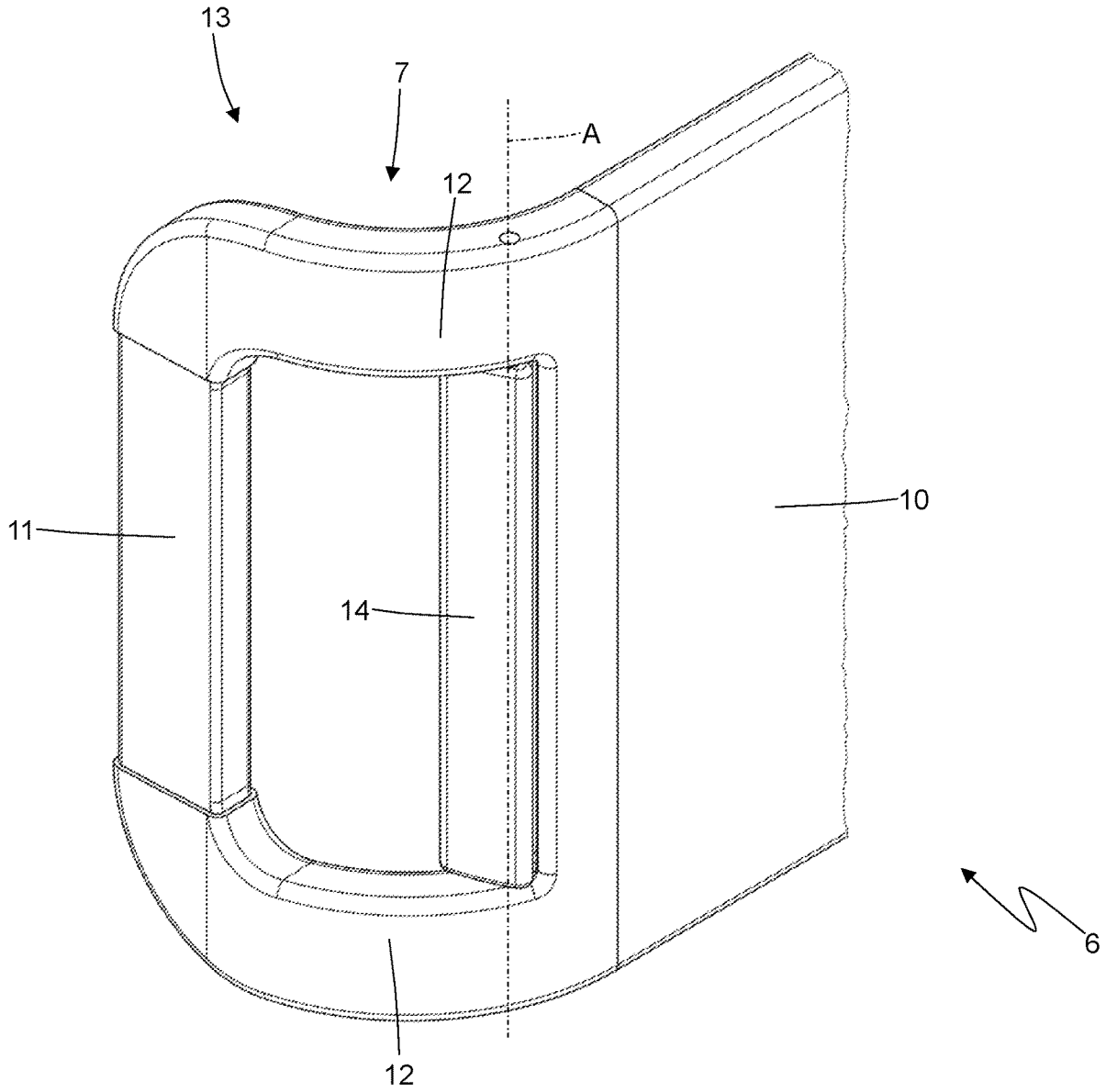
FIG. 4 is a perspective view of a grip of the telescopic handle of FIG. 1.

According to FIGS. 3 and 4, the grip 7 comprises a handle 11, which is connected to the movable plate 10 by means of two connection crosspieces 12, which are arranged at the opposite ends of the handle 11; namely, the handle 11 joins the two connection crosspieces 12 to one another (acting like a "bridge").

The telescopic handle 6 comprises a locking system 13, which is designed to lock the sliding of the movable plate 10 relative to the fixed plate 9 in the contracted position and in the extended position (but not in the rest position, namely the sliding of the movable plate 10 from the rest position is completely free).

The locking system 13 comprises a control lever 14, which is arranged inside the grip 7 between the two connection crosspieces 12 and is hinged to the two connection crosspieces 12 so as to rotate around a rotation axis A, which is perpendicular to the sliding direction D1.

The locking system 13 comprises four stop seats 15, two of them (which are aligned with one another along the sliding direction D1) defining the contracted position and the other two of them (which are aligned with one another along the sliding direction D1) defining the extended position. Furthermore, the locking system 13 comprises two stop pawls 16, which are arranged beside one another in a mirror-like manner (and, hence, are aligned with one another along the sliding direction D1) and are movable along a stop direction D2, which is perpendicular to the sliding direction D1.

Figure 5:
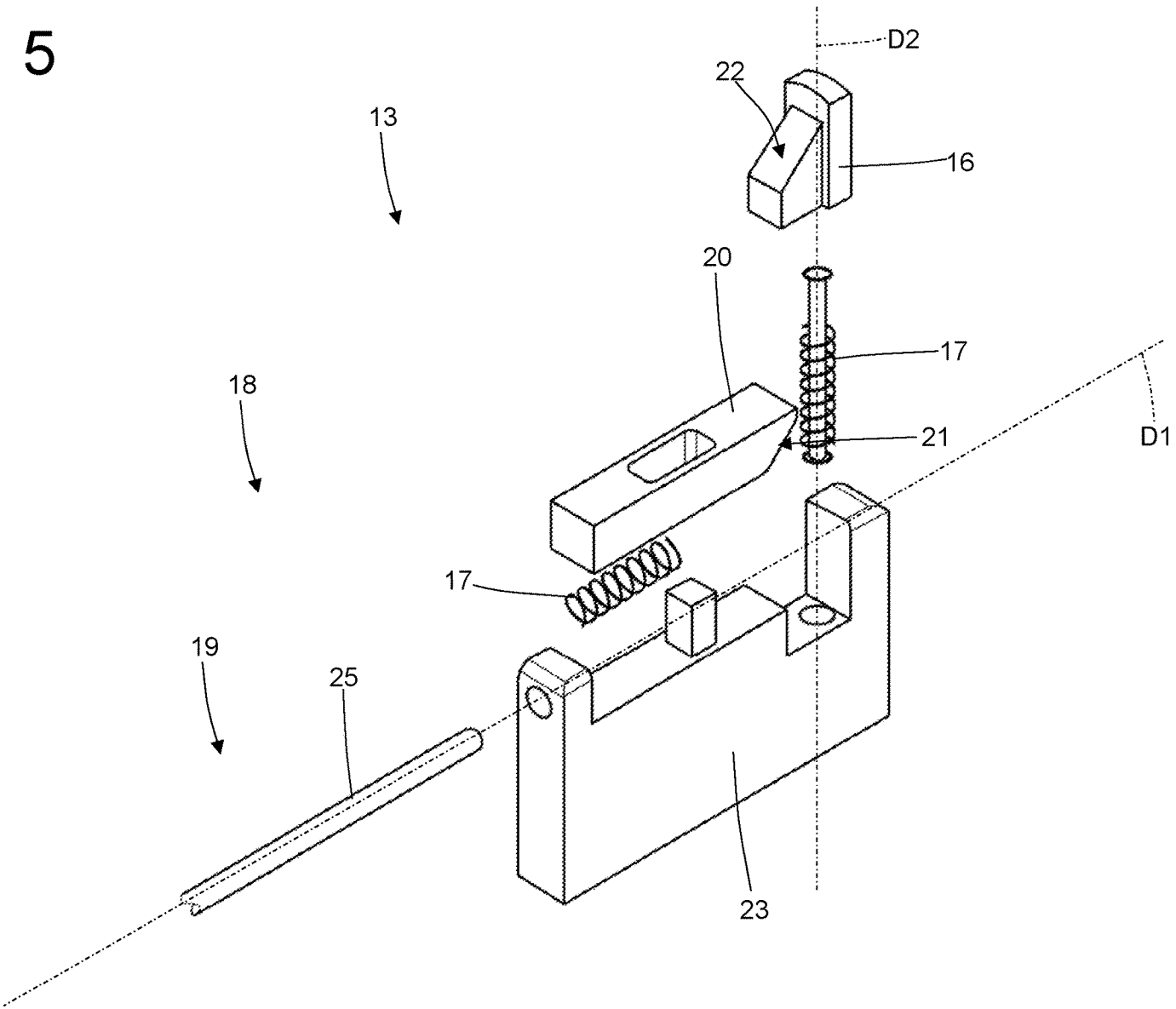
FIG. 5 is a perspective and exploded view of part of a locking system of the telescopic handle of FIG. 1.
Figure 6:
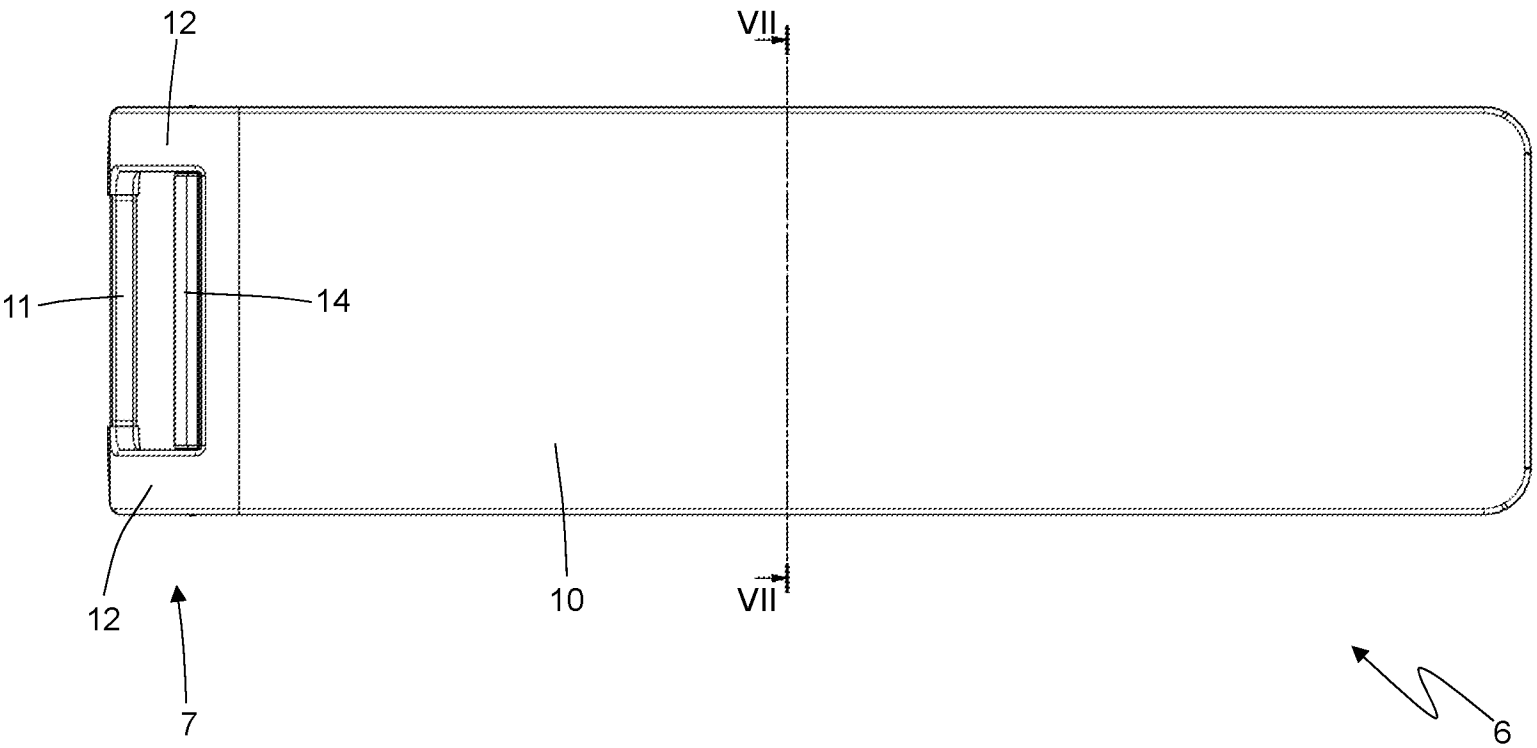
FIG. 6 is a plan view of the telescopic handle of FIG. 1 in the rest position.

According to FIG. 5, the locking system 13 comprises elastic elements 17 (in particular spiral springs), each pushing a corresponding stop pawl 16 towards the corresponding stop seat 15, and two twin transmission lines 18, each transmitting the movement from the control lever 14 to a corresponding stop pawl 16 pushing the stop pawl 16 away from the stop seats 15, thus compressing the elastic elements 17.

Normally (namely, if users do not act upon the control lever 14), the elastic elements 17 push the stop pawls 16 into the corresponding stop seats 15 (obviously, when the stop pawls 16 are aligned with the corresponding stop seats 15); by acting upon the control lever 14 (namely, by moving the control lever 14), the movement of the control lever 14 is transmitted to the stop pawls 16 through the transmission lines 18 and, therefore, the stop pawls 16 are pushed (along the stop direction D2) away from the stop seats 15, thus compressing the elastic elements 17.

Each transmission line 18 comprises an idler rod 19 having an upper end, which receives the motion from the control lever 14, and a lower end, which transmits the motion to the stop pawl 16; furthermore, each transmission line 18 comprises a slider 20, which is integral to the lower end of the idler rod 19 and transmits the motion to the stop pawl 16 by means of a coupling with inclined planes. In particular, each slider 20 comprises an inclined plane 21 (having a 45° inclination) and each stop pawl 16 comprises an inclined plane 22 (having a 45° inclination), which has the same inclination angle as the inclined plane 21 and rests against the inclined plane 21 so as to slide on the inclined plane 21. Thanks to the two inclined planes 21 and 22, the movement of each idler rod 19 taking place along the sliding direction D1 is transmitted to the corresponding slider 20, which slides along the stop direction D2 (which is perpendicular to the sliding direction D1); in other words, the inclined plane coupling allows the thrust transmitted by each idler rod 19 to be rotated by 90°.

According to a preferred embodiment, each transmission line 18 comprises a support body 23, which is integral to the movable plate 10 and houses, on the inside, the slider 20, the stop pawl 16 and the elastic elements 17.

Figure 8:
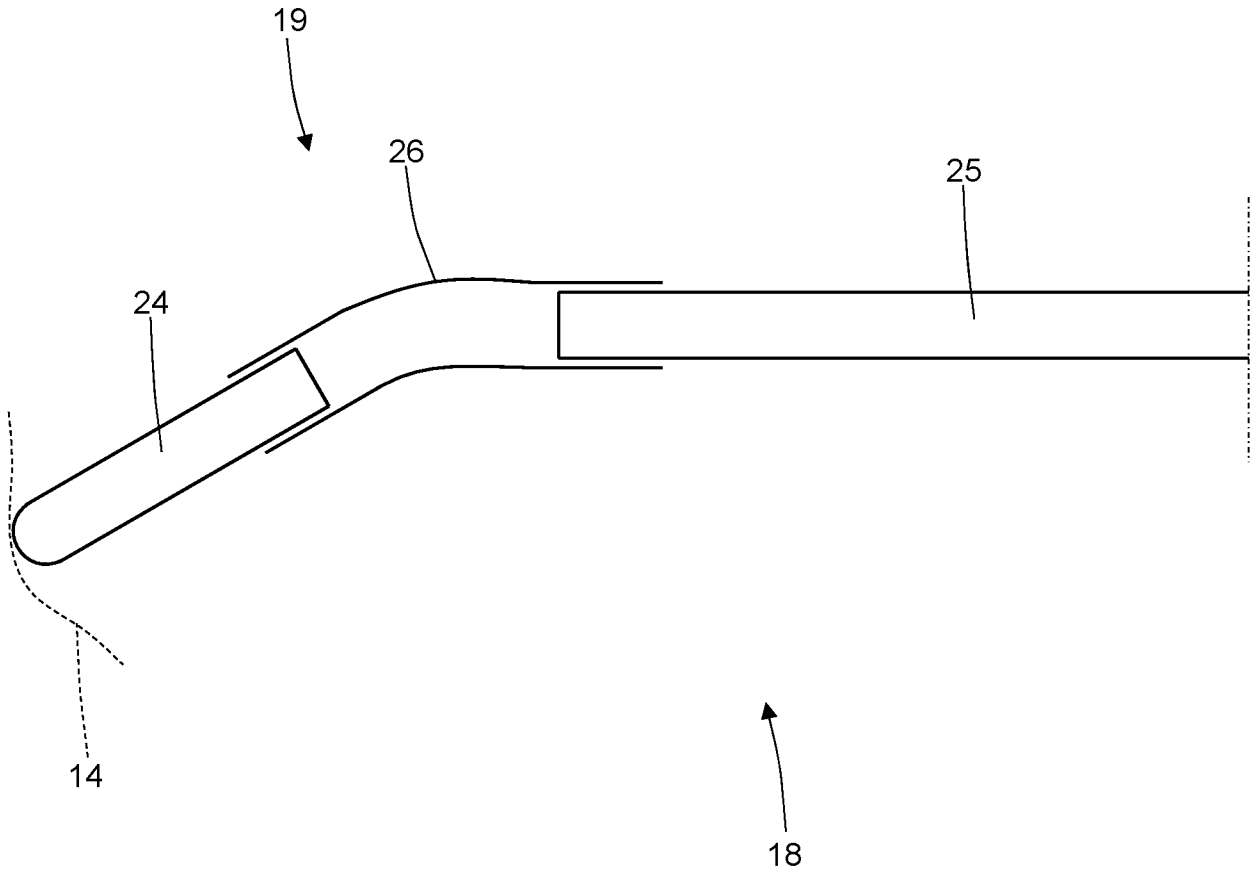
FIG. 8 is a side view of part of a transmission line of a locking system of the telescopic handle of FIG. 1.

According to a preferred embodiment shown in FIG. 8, the upper end of each idler rod 19 simply rests against a lower surface of the control lever 14 (namely, the upper end of each idler rod 19 does not have any stable connection to the lower surface of the control lever 14). The lower surface of the control lever 14 has a variable bending radius relative to the rotation axis A so as to push the upper end of the idler rod 19 during its rotation around the rotation axis A.

According to a preferred embodiment, each idler rod 19 comprises: an initial pin 24, which is rigid, has a straight shape, and is mechanically coupled to the control lever 14 namely 8, rests against the lower surface of the control lever 14), a final stem 25, which is rigid, has a straight shape, and is mechanically coupled to the slider 20 (namely, is integral to the slider 20), an intermediate portion 26, which has a curved shape and is interposed between the initial pin 24 and the final stem 25 (namely, joins/connects the initial pin 24 and the final stem 25 to one another).

Preferably, each intermediate portion 26 is elastically deformable and consists of a Rilsan® tube.

Figure 7:
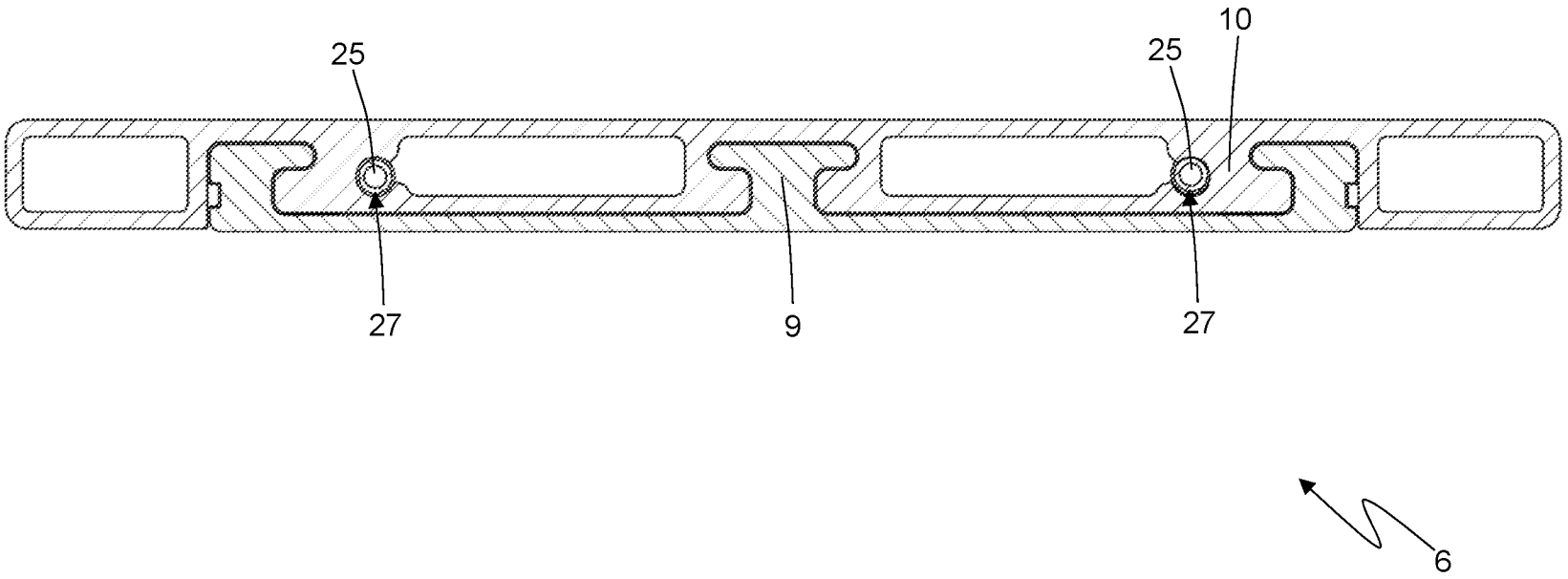
FIG. 7 is a cross section view along line VII-VII of the telescopic handle of FIG. 1.

According to a preferred embodiment which is shown in FIG. 7, the movable plate 10 comprises a pair of passage holes 27, each developing along the sliding direction D1, having the same diameter as the corresponding final stem (25) (except for a small clearance to allow for the sliding of the final stem 25) and houses, on the inside and in a sliding manner, the final stem 25. The fact that the each final stem 25 is inserted into a passage hole 27, which is only slightly larger than the final stem 25, prevents the final stem 25 from being loaded at the point and, hence, from (significantly) bending.

According to a preferred embodiment shown in FIGS. 3 and 4, each connection crosspiece 12 has a first hole, which partially houses a cylindrical peg, which, for the remaining part, is inserted into a second dead hole made in the control lever 14; each cylindrical peg is parallel to the rotation axis A and creates the hinge of the control lever 14 so as to allow the control lever 14 to rotate around the rotation axis A.

According to a preferred embodiment shown in FIG. 7, the fixed plate 9 and the movable plate 10 are connected to one another by means of two dovetail joints arranged beside one another, which only allow for a relative sliding along the sliding direction D1.

According to a preferred embodiment, the plates 9 and 10 are made of extruded aluminium and are coated, on the outside, with a nickel layer obtained by means of chemical nickel plating (for example carried out with a NIPLOY® process); in other words, the plates 9 and 10 are completely covered by a nickel layer obtained through chemical nickel plating. The functions of the nickel layer are: significantly reducing frictions during the sliding between the plates 9 and 10, increasing the surface hardness (which can reach up to 1000-1200 in the Vickers scale) of the plates 9 and 10 (so as to reduce the wear caused by the sliding and, hence, increase the duration of the coupling between the plates 9 and 10), and increasing the resistance to corrosion (the nickel layer offers a high resistance also to salt spray).

Preferably, the grip 8 is made of (injection-moulded) aluminium and is coated, on the outside, with a nickel layer obtained by means of chemical nickel plating. Preferably, the initial pins 24 and the final stems 25 are made of brass and are coated, on the outside, with a nickel layer obtained by means of chemical nickel plating. The sliders 20 and the support bodies 23, on the other hand, are made of a plastic material (for example nylon), whereas the stop pawls 16 are made of (injection-moulded) aluminium and are coated, on the outside, with a nickel layer obtained by means of chemical nickel plating.

The embodiments described herein can be combined with one another, without for this reason going beyond the scope of protection of the invention.

The telescopic handle 6 described above has numerous advantages.

First of all, the telescopic handle 6 described above has small dimensions and a limited weight: the total thickness of the two plates 9 and 10 coupled to one another can be smaller than 10 mm (for example 8-9 mm), though ensuring a high rigidity also in the extended position (namely, when the movable plate 10 is almost completely extracted from the fixed plate 9).

Furthermore, the telescopic handle 6 described above is externally resistant both to mechanical stresses (the double dovetail joint between the plates 9 and 10 determines the formation, in the plates 9 and 10, of "T"-shaped beams, which allow for an extreme sturdiness of the whole assembly) and to atmospheric agents (especially thanks to the outer nickel layer).

Finally, the telescopic handle 6 described above is simple and economic to be manufactured, since it consist of a limited number of components, which are available in the market or can be produced with standard mechanical machining operations.

LIST OF THE REFERENCE NUMBERS OF THE FIGURES

1 suitcase
2 shell
3 lower wall
4 wheels
5 rear wall
6 telescopic handle
7 grip
8 upper wall
9 fixed plate
10 movable plate
11 handle
12 connection crosspieces
13 locking system
14 control lever
15 stop seats
16 stop pawl
17 elastic elements
18 transmission lines
19 idler rod
20 slider
21 inclined plane
22 inclined plane
23 support body
24 support body
25 final stem
26 intermediate portion
27 passage hole
D1 sliding direction
D2 stop direction
A rotation axis

The invention claimed is:

1. A telescopic handle (6) for a suitcase (1); the telescopic handle (6) comprises:

a fixed plate (9), which is designed to be fixed to a rear wall (5) of the suitcase (1);

a movable plate (10), which is coupled to the fixed plate (9) in a sliding manner so as to slide relative to the fixed plate (9) along a sliding direction (D1) and between a retracted position and an extended position;

a grip (7), which is fixed to an upper wall of the movable plate (10), is "U"-shaped, and comprises a handle (11), which is connected to the movable plate (10) by means of two connection crosspieces (12), which are arranged at the opposite ends of the handle (11); and a locking system (13), which is designed to lock the sliding of the movable plate (10) relative to the fixed plate (9) when it reaches the extended position and comprises a control lever (14), which is arranged inside the grip (7) between the two connection crosspieces (12);

wherein the locking system (13) comprises at least two stop seats (15), which are obtained in the fixed plate (9) and define the retracted position and the extended position, respectively;

wherein the locking system (13) comprises a stop pawl (16), which is supported by the movable plate (10), is designed to be inserted into each stop seat (15), and is movable along a stop direction (D2), which is perpendicular to the sliding direction (D1);

wherein the locking system (13) comprises at least one elastic element which pushes the stop pawl (16) towards the stop seats (15);

wherein the locking system (13) comprises a transmission line (18), which transmits the movement of the control lever (14) to the stop pawl (16) so as to push the stop pawl (16) away from the stop seats (15), thus compressing the elastic element (17);

wherein the transmission line (18) comprises an idler rod (19) having an upper end, which receives the motion from the control lever (14), and a lower end, which transmits the motion to the stop pawl (16);

wherein the transmission line (18) comprises a slider (20), which is integral to the lower end of the idler rod (19) and transmits the motion to the stop pawl (16) by means of a coupling with inclined planes;

the telescopic handle (6) is characterized in that:

the control lever (14) is hinged to the two connection crosspieces (12) so as to rotate around a rotation axis (A), which is perpendicular to the sliding direction (D1);

the idler rod (19) comprises an initial pin (24), which is rigid, has a straight shape, and is mechanically coupled to the control lever (14);

the idler rod (19) comprises a final stem (25), which is rigid, has a straight shape, and is mechanically coupled to the slider (20); and the idler rod (19) comprises an intermediate portion (26), which has a curved shape and is interposed between the initial pin (24) and the final stem (25).

2. The telescopic handle (6) according to claim 1, wherein the locking system (13) comprises:

four stop seats (15), two of them defining the retracted position and the other two defining the extended position;

two stop pawls (16), which are arranged beside one another in a mirror-like manner;

at least two elastic elements (17), each pushing a corresponding stop pawl (16); and two twin transmission lines (18), each transmitting the movement of the control lever (14) to a corresponding stop pawl (16).

3. The telescopic handle (6) according to claim 1, wherein:

the slider (20) comprises a first inclined plane (21); and the stop pawl (16) comprises a second inclined plane (22), which has the same inclination angle as the first inclined plane (21) and rests against the first inclined plane (21) so as to slide on the first inclined plane (21).

4. The telescopic handle (6) according to claim 3, wherein the transmission line (18) comprises a support body (23), which is integral to the movable plate (10) and houses, on the inside, the slider (20), the stop pawl (16) and the elastic element (17).

5. The telescopic handle (6) according to claim 1, wherein:

the upper end only rests against a lower surface of the control lever (14); and the lower surface of the control lever (14) has a variable bending radius relative to the rotation axis (A) so as to push the upper end of the idler rod (19) during its rotation around the rotation axis (A).

6. The telescopic handle (6) according to claim 1, wherein the intermediate portion (26) is elastically deformable.

7. The telescopic handle (6) according to claim 6, wherein the intermediate portion (26) consists of a Rilsan tube.

8. The telescopic handle (6) according to claim 1, wherein the movable plate (10) comprises a passage hole (27) having the same diameter as the final stem (25) and housing, on the inside and in a sliding manner, the final stem (25).

9. The telescopic handle (6) according to claim 1, wherein each connection crosspiece (12) has a first hole where a cylindrical plug is inserted, which, for the remaining part, is inserted into a second hole made in the control lever (14).

10. The telescopic handle (6) according to claim 1, wherein the movable plate (10) slides along the sliding direction (D1) between:

a rest position, in which the grip (7) adheres to an upper wall (8) of the suitcase (1);

the retraced position, in which the grip (7) is detached from the upper wall (8) of the suitcase (1); and the extended position, in which the grip (7) is farther from the upper wall (8) of the suitcase (1) than in the retracted position.

11. The telescopic handle (6) according to claim 10, wherein the locking means (13) locks the sliding of the movable plate (10) relative to the fixed plate (9) only in the retracted position and in the extended position, but not in the rest position.

12. The telescopic handle (6) according to claim 1, wherein the fixed plate (9) and the movable plate (10) are coated, on the outside, with a nickel layer obtained by means of chemical nickel plating.

13. The telescopic handle (6) according to claim 1, wherein the fixed plate (9) and the movable plate (10) are connected to one another by means of a dovetail joint, which exclusively allows for a relative sliding along the sliding direction (D1).

14. The telescopic handle (6) according to claim 13, wherein the fixed plate (9) and the movable plate (10) are connected to one another by means of two dovetail joints arranged beside one another.

15. A suitcase (1) comprising:

an openable shell (2) with the shape of a parallelepiped, which can hold objects to be transported;

at least two wheels (4), which are fixed to a lower wall (3) of the shell (2); and a telescopic handle (6), which is fixed to a rear wall (5) of the shell (2) and is manufactured according to claim 1.

* * * * *